US008888313B2

(12) United States Patent
Green et al.

(10) Patent No.: US 8,888,313 B2
(45) Date of Patent: Nov. 18, 2014

(54) LIGHT EMITTING DIODE TROFFER DOOR ASSEMBLY

(75) Inventors: Scott A. Green, Ponte Vedra Beach, FL (US); Scott W. Lowden, Orange Park, FL (US); Efrain Padilla, Elkton, FL (US); George S. Wilson, Middleburg, FL (US)

(73) Assignee: Harris Manufacturing, Inc., Green Cove Springs, FL (US)

( * ) Notice: Subject to any disclaimer, the term of this patent is extended or adjusted under 35 U.S.C. 154(b) by 275 days.

(21) Appl. No.: 13/414,032

(22) Filed: Mar. 7, 2012

(65) Prior Publication Data

US 2013/0235568 A1 Sep. 12, 2013

(51) Int. Cl.
*F21V 21/30* (2006.01)
*F21V 21/34* (2006.01)

(52) U.S. Cl.
USPC ..... 362/218; 362/217.11; 362/217.12; 362/217.15

(58) Field of Classification Search
CPC ..... F21V 21/00; F21V 21/02; F21V 21/025; F21V 21/03; F21V 21/04; F21V 21/041; F21V 21/047; F21V 21/048; F21V 21/049; F21V 29/00; F21V 29/002; F21V 29/20; F21V 29/22; F21Y 2103/003
USPC ..... 362/217.01–225
See application file for complete search history.

(56) References Cited

U.S. PATENT DOCUMENTS

| | | | | |
|---|---|---|---|---|
| 3,019,333 | A * | 1/1962 | Pascucci | 362/355 |
| 3,078,366 | A | 2/1963 | Winkler | |
| 5,997,158 | A | 12/1999 | Fischer et al. | |
| 6,059,424 | A | 5/2000 | Kotloff | |
| 6,231,213 | B1 | 5/2001 | Schmidt et al. | |
| 6,739,734 | B1 | 5/2004 | Hulgan | |
| 6,871,983 | B2 | 3/2005 | Jacob et al. | |
| 7,758,207 | B1 | 7/2010 | Zhou et al. | |
| 7,845,824 | B2 | 12/2010 | Robotham | |
| 8,066,407 | B2 | 11/2011 | Remus et al. | |
| 8,092,044 | B1 | 1/2012 | Sikora | |
| 2007/0047238 | A1 | 3/2007 | Vukosic et al. | |
| 2008/0266843 | A1 | 10/2008 | Villard | |
| 2009/0290348 | A1* | 11/2009 | Van Laanen et al. | 362/249.02 |
| 2010/0091484 | A1 | 4/2010 | Mayfield et al. | |
| 2012/0051041 | A1* | 3/2012 | Edmond et al. | 362/231 |
| 2012/0176784 | A1 | 7/2012 | Peifer et al. | |

OTHER PUBLICATIONS

International Search Report and Written Opinion for International Application No. PCT/US/13/29301; mailing date May 20, 2013, 8 pages.

* cited by examiner

*Primary Examiner* — Karabi Guharay
*Assistant Examiner* — Nathaniel Lee
(74) *Attorney, Agent, or Firm* — Foley & Lardner LLP

(57) ABSTRACT

A troffer door assembly having a heat conductive frame assembly, a lens member and a light emitting diode (LED) assembly having a rigid heat conductive brace member, wherein the rigid brace member is affixed to the frame assembly such that the rigidity of the frame assembly is increased and such that heat is passed from the rigid brace member to the frame assembly. Hinge members and latch members are positioned in exterior slots on the frame assembly such that the location of the hinge members and latch members can be adjusted. In this manner installed troffer light fixtures can be retrofitted by replacing the installed troffer door with the troffer door assembly as described.

28 Claims, 5 Drawing Sheets

LIGHT EMITTING DIODE TROFFER DOOR ASSEMBLY

BACKGROUND OF THE INVENTION

The invention relates generally to troffer light fixtures, more particularly to troffer light fixtures having a removable hinged door or a removable hinged louver, and even more particularly to replacement doors or louvers for retrofitting troffer light fixtures, doors and louvers that are already installed.

A troffer light fixture is a generally rectangular or square tray-like housing comprising a top body wall and four shorter side walls that is installed in or on a ceiling in an inverted manner such that it is open toward the floor. Electrical components, ballast, hardware and the like are affixed to the top body wall and/or the side walls. These components operate the light producing elements, typically one or more elongated or U-shaped tubular fluorescent lamps. A removable panel member typically comprises either a diffusion lens or a louver and is retained by the troffer housing by hinge and latch members, the panel being removable to allow replacement of the fluorescent lamps and other electrical components when needed. The panel member may have many configurations, such as flat, curved, angled, segmented, etc. In some troffers, the removable panel member further comprises a relatively rigid peripheral frame assembly with hinge members and latch members that are received by short slots or openings in the troffer housing assembly. With this structure, the troffer door assembly or louver can be unlatched and pivoted open on the hinge members, and the hinge members are often separable from the troffer housing assembly such that the entire door panel or louver may be removed.

Light emitting diodes (LEDs) have been developed that are less expensive to operate and have a much greater working life than incandescent bulbs and fluorescent lamps, and when assembled into arrays of multiple LEDs have been found to be excellent replacements for the tubular fluorescent lamps in troffer assemblies. An array of LEDs mounted to a relatively rigid support structure is often referred to as an LED light bar. The LEDs are powered by a power supply commonly known as a driver. The driver and LED light bar are collectively an LED system and replace the electrical components, ballast, hardware and the like used in fluorescent fixtures. Because LED systems produce significant heat during operation, the support structure for the LED system is usually constructed to function as a heat sink and/or heat radiating member such that heat is conducted away from the LED system.

The current method of retrofitting most installed troffer light fixtures to replace the fluorescent lamps and associated electrical components with one or more LED light bars involves removing the non-essential electrical components, ballast and hardware mounted within the troffer housing so that there is enough room, clearance and exposed surfaces for installation of the LED light bars, then mounting the LED light bars or panels to the interior body wall or the top/side walls of the troffer housing using mechanical fasteners. This is a time consuming and expensive process.

It is an object of this invention to improve on the methodology of retrofitting troffer light fixtures by providing a novel troffer door assembly wherein one or more LED light bars are directly affixed to the peripheral frame in a manner allowing for conduction of heat from the LED light bars to the frame. The peripheral frame thereby functions as a heat sink in addition to the light bar support structure. Furthermore, the LED light bars are rigidly connected to the peripheral frame in a manner that provides increased structural integrity to the troffer door assembly. It is a further object to provide a troffer door assembly wherein the peripheral frame is formed with elongated exterior slots to receive the latch members and the hinge members in a manner that allows their positions along the frame to be adjusted as required to correspond to the variety and location of latch and hinge openings that may be encountered in the field during the retrofit process. It is a further object to provide a troffer door assembly having elongated interior slots adapted to receive therein all or some of the peripheral edges of the panel member. These objects, along with other objects not expressly set forth here, will be apparent from the detailed disclosure to follow.

SUMMARY OF THE INVENTION

A troffer door assembly with a light emitting diode (LED) light bar is adapted for combination with an installed troffer light fixture, whereby the troffer light fixture may be retrofitted by removing the original panel, louver or door member and replacing such with the troffer door assembly as herein described. The troffer door assembly comprises a peripheral frame assembly composed of individual frame members joined by connecting members to form a rectangular or square configuration, a panel member positioned within the peripheral frame assembly, and one or more LED light bars comprising an array of LEDs and driver disposed on a backing member and rigid brace member. The backing member may have an elongated, square, circular or other configuration, and the rigid brace member may be an elongated linear member or may be configured to match the configuration of the backing member. The brace member is composed of a material possessing high heat conductivity and in all cases acts as a heat sink and/or heat disperser to account for heat created by the LED system. The brace member of the LED light bar or bars is rigidly affixed to opposing frame members to increase the structural rigidity of the frame assembly and such that the frame assembly also functions as a heat sink and/or heat disperser, the frame members being composed of a material possessing high heat conductivity. Multiple LED light bars may be used in parallel or intersecting manner within a single door frame assembly.

In a preferred embodiment, the frame members of the troffer door assembly are provided with elongated slots on the exterior side of the frame members, such that the hinge members and latch members for securing the troffer door assembly to the housing of the installed troffer light fixture are movable relative to the frame members and may be adjusted to the proper location to correspond to the location of the hinge and latch receiving slots of the existing troffer housing. Also, elongated slots may be present on the interior side of the frame members, whereby the peripheral edges of the panel member may be positioned within the interior slot.

With this structure, the troffer door assembly provides increased rigidity and improved heat removal functionality, and allows for the creation of an LED troffer light fixture from a previous non-LED troffer light fixture without necessarily requiring the removal of the non-essential electrical components, ballasts and hardware. The retrofitting process is accomplished in a relatively short time frame, since all that is required is the removal of the original troffer panel, louver or door, removal of the existing fluorescent lamps, adjustment of the location of the hinge and latch members on the frame assembly to correspond to the location of the receiving slots on the troffer housing, connection of the electrical wiring, and closure and securement of the troffer door assembly with the hinge and latch members.

DETAILED DESCRIPTION OF THE INVENTION

With reference to the drawings, the troffer door assembly with light emitting diode (LED) light bar will be described in detail with regard for the preferred or preferred embodiments. In a broad sense, the troffer door assembly is a retrofit device to replace the panel, louvers or doors of presently installed troffer light fixtures, which in certain preferred embodiments provide adjustable position latch and hinge members such that the location of the latch and hinge members can be altered to correspond to the location of the latch and hinge receiving slots of the installed troffer housing.

A typical troffer light fixture comprises a shallow, rectangular or square trough or tray-like housing having a top body member and shorter depending side walls. The electrical components, ballast and hardware for retaining and operating the elongated lamp members, typically linear fluorescent tubes, are affixed to the top body member or side walls of the troffer housing. Electrical wiring is passed through the troffer housing to a power source. The troffer housing defines a rectangular or square opening and receiving frame to which a lens panel assembly, louver assembly or door assembly (referred to herein collectively as a door assembly) is connected. For the troffer door assembly, latches and hinges are mounted on a peripheral frame, and the troffer receiving frame is provided with corresponding slots to receive the latches and hinges. Typically the troffer door assembly may be removed completely from the troffer housing.

Figure 1:
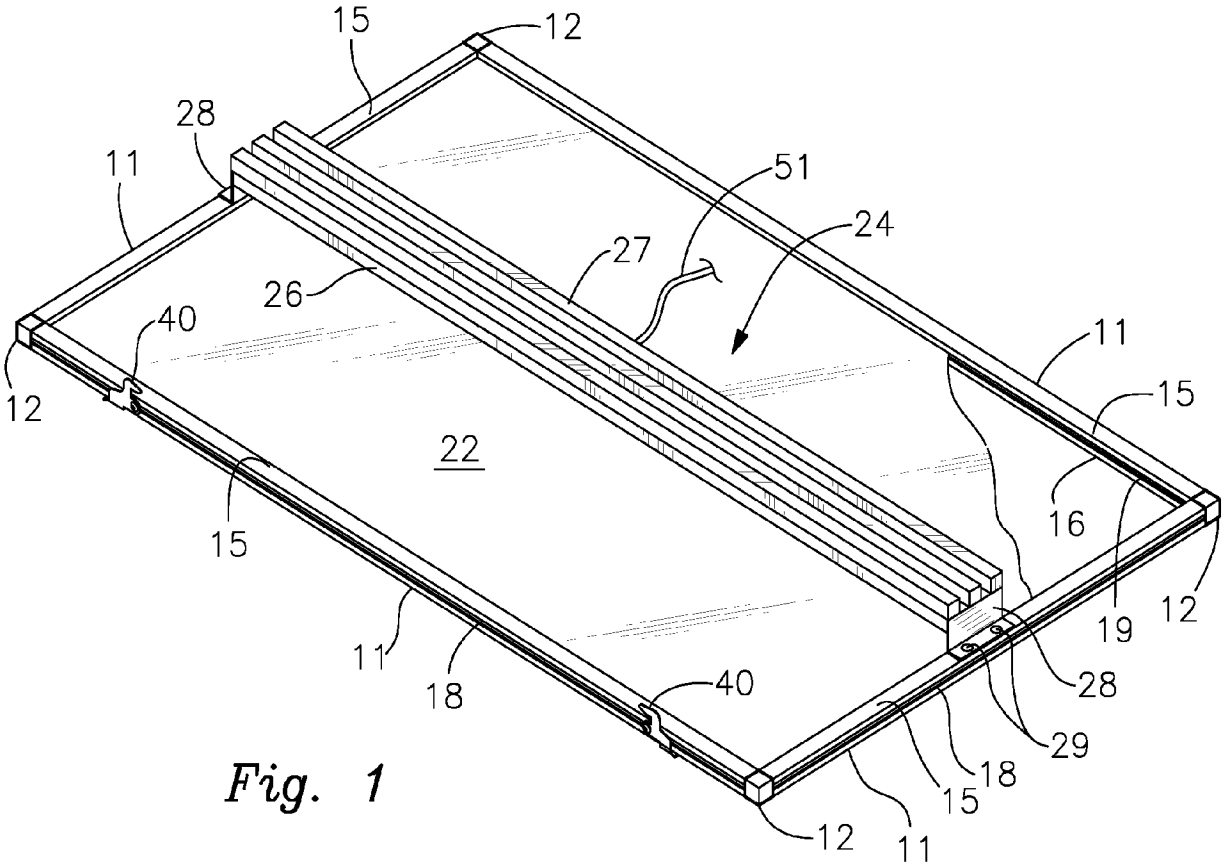
FIG. 1 is a perspective view of an embodiment of the removable troffer door assembly, showing for example a flat panel member and a single LED light bar.

As seen in FIG. 1, the troffer door assembly of the invention comprises a peripheral frame assembly comprising the combination of plural frame members 11 joined by connecting members 12 to form a rectangular or square configuration. The troffer door assembly further comprises a panel member or louver, to be referred to herein collectively as lens member 22, which may be transparent, translucent or apertured such that light passes through the lens member 22 and into the room below. Lens member 22 is typically composed of acrylic or polycarbonate to minimize weight, and is usually a thin member that will flex slightly from a planar configuration when disposed horizontally in the frame assembly. Lens member 22 may be flat as shown in the drawings, or may be formed with curves, angles, edges, walls, etc., to present a more pleasing appearance when installed.

Figure 5:
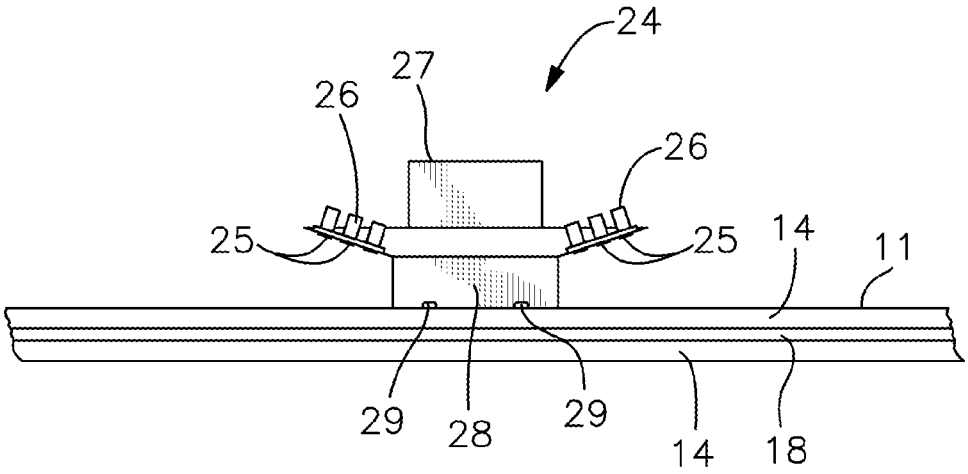
FIG. 5 is a partial end view of an alternative embodiment of an LED light bar.

The troffer door assembly further comprises at least one LED light bar assembly 24, the LED light bar assembly 24 comprising a driver and an array of LEDs 25 positioned on an array backing member 26 in known manner to provide functionality to the LEDs 25. The LEDs 25 may be positioned in various arrangements on the backing member 26, as shown for example in FIG. 5. The LED light bar assembly 24 further comprises a rigid brace member 27, this brace member 27 providing rigidity to the backing member 26 and covering the driver. The brace member 27 is formed of a material possessing high heat conductivity properties or characteristics (referred to as a "heat conductive material" hereafter—the term having its ordinary and plain meaning, as opposed to a heat insulating material, as the terms would be understood by one possessing ordinary skill in the art), such as, for example, aluminum metal, such that the brace member 27 functions as a heat sink and/or heat disperser (to be referred to herein collectively as a "heat sink") to remove and dissipate heat created by the LEDs. The brace member 27 may be provided with elongated fins or ridges, as shown in FIG. 1, in order to radiate the heat. The ridges also serve to increase the rigidity of brace member 27 while reducing the overall weight of the LED light bar assembly 24. Minimizing the overall weight of the troffer door assembly is important as heavier assemblies may require the use of safety chains connected to the troffer housing or other structural members in the ceiling. Electrical wiring 51 is provided for connecting the LED light bar assembly to a power source.

The LED light bar assembly 24, and more particularly the brace member 27, is fixedly mounted to opposing frame members 11 with rigid mounting brackets 28 and mechanical fasteners 29 such that the structural rigidity of the LED light bar assembly 24 is transferred to the frame assembly, thereby increasing the overall rigidity of the frame assembly. Single or multiple LED light bar assemblies 24 may be present in a troffer door assembly, and the brace member or members 27 may extend longitudinally or transversely. In one embodiment the backing members 26 and brace members 27 of the LED light bar assemblies 24 are elongated and linear, in other embodiments the backing members 26 may be square, circular or of other configurations with linear brace members 27, and in still other embodiments the backing members 26 and the brace members 27 may have matching configurations.

The mounting brackets 28 are formed of a heat conductive material, as are the frame members 11, such as for example aluminum metal, such that heat is transferred from the brace member 27 into the frame members 11. In this manner the peripheral frame assembly also functions as a heat sink for the LED light bar assembly 24. The mounting brackets 28 may be separate members connected to the ends of the brace member 27, or the ends of the brace member 27 may be formed to extend a short distance from the main body to define a mounting flange or bracket 28. Preferably each mounting bracket 28 is provided with a laterally extending flange member for connection to the top surface 15 of frame member 11 using a mechanical fastener 29, such as, for example, a threaded member positioned within a threaded bore located in the top surface 15. Alternatively, the mounting brackets 28 may be rigidly affixed to opposing frame members 11 by welding, mechanical interlock or other similar mechanisms.

An elongated interior slot 19 is located in the interior surface 16 of the frame member 11, the frame member 11 being provided with internal structural members 17 to maintain the rigidity of the frame member 11, which is preferably manufactured as an extruded member. The interior slots 19 are adapted to receive the peripheral edges of the lens member 22, such that the lens member 22 is supported by the frame members 11. With all frame members 11 provided with an interior slot 19, all four peripheral edges 23 of the lens member 22 can be received and supported by the interior slots 19 and no additional hardware is required to retain and support the lens member 22.

In the more preferred embodiment, each of the frame members 11 is also provided with an elongated exterior slot 18 disposed on the exterior surface 14. The exposed bottom surface 13 of the frame members 11 is preferably not slotted to present a more pleasing appearance. The exterior slots 18 are utilized on one side of the frame assembly for the retention of one or more latch members 40 and on the other side of the frame assembly one or more hinge members 30 in a manner that allows the latch members 40 and the hinge members 30 to be adjusted or repositioned longitudinally along the exterior slots 18 of the frame member 11 for proper alignment with the receiving slots of the existing troffer housing.

Figure 2:
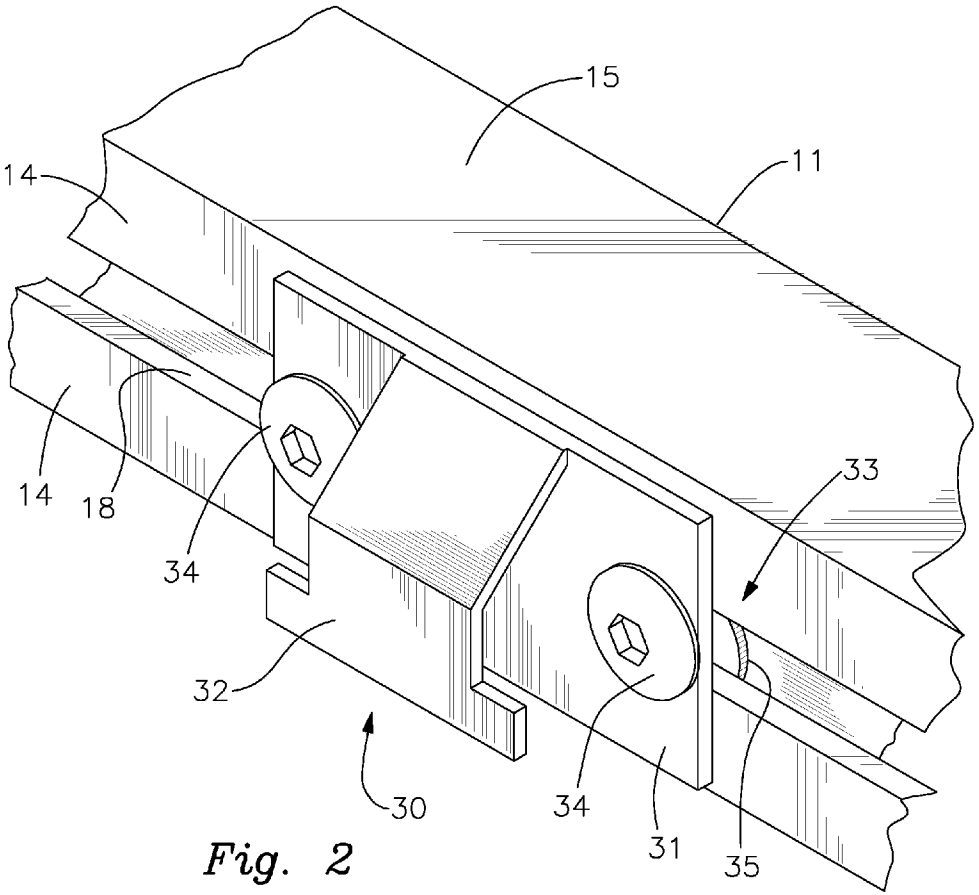
FIG. 2 is a partial perspective view showing an embodiment of a hinge member.

As shown in FIG. 2, an embodiment of the hinge members 30 comprises an extension member 32 that extends outwardly at an angle from a mounting plate 31, the extension member 32 being configured to be received by the troffer housing slot such that the troffer door assembly may be pivoted between an open and closed position relative to the troffer housing. The mounting plate 31 is provided with a retention mechanism 33 extending into exterior slot 18 that functions to retain the mounting plate 31 on the frame member 11 while allowing the hinge member 30 to be moved in either direction along exterior slot 18. A representative retention mechanism 33 may comprise one or more fasteners 34, such as a rivet or threaded bolt, extending though apertures in the mounting plate 31 and connecting to one or more internal backing members 35, such as a nut or plate, of sufficient size to prevent outward separation of the hinge member 30 from the frame member 11. The hinge member 30 is easily assembled to the frame 11 by sliding it into the exterior slot 18 prior to assembly of the frame members 11 into the peripheral frame assembly.

Figure 3:
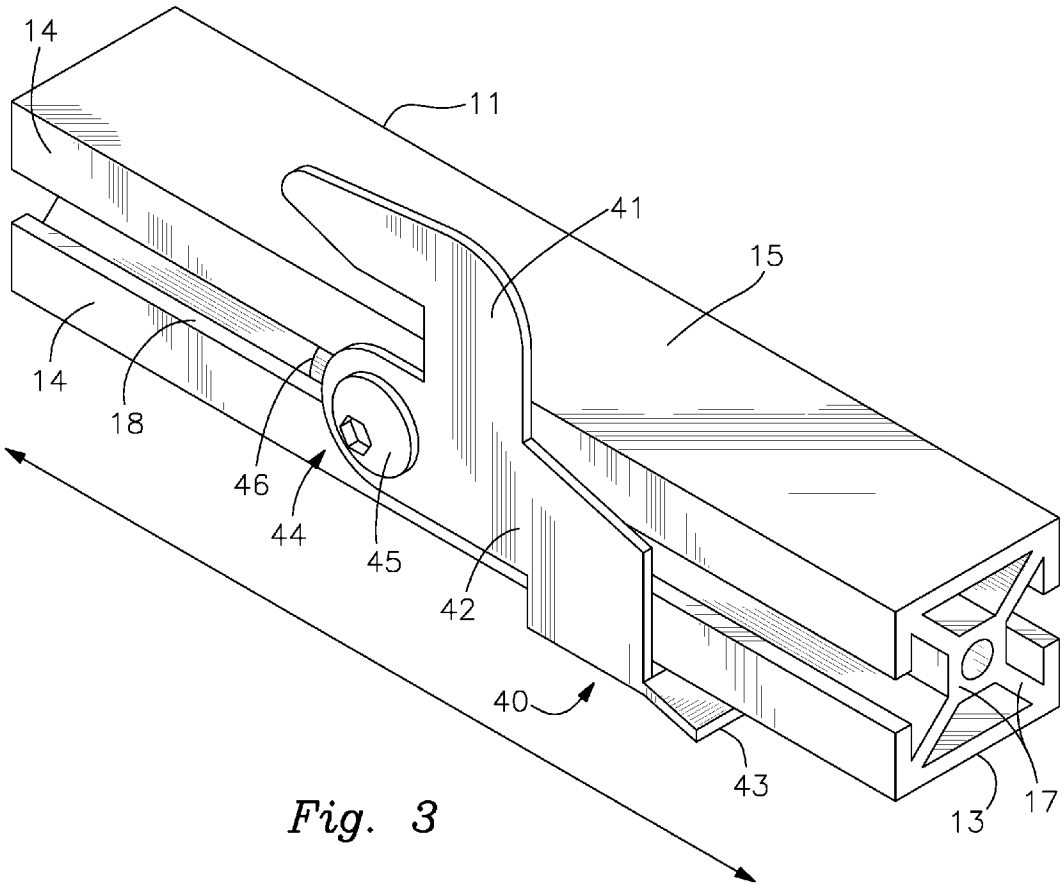
FIG. 3 is a partial perspective view showing an embodiment of a latching member.
Figure 4:
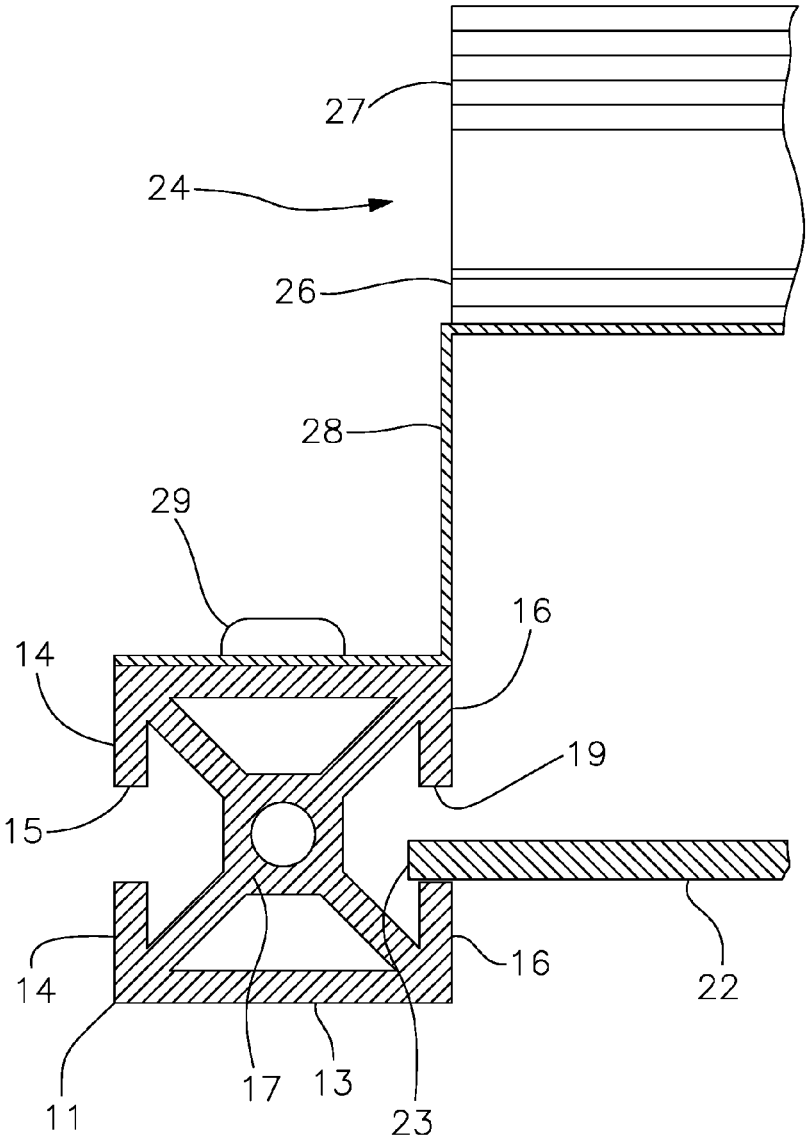
FIG. 4 is a partial cross-sectional view showing an embodiment of a lens member as received by a frame member and an embodiment of the LED light bar mounted to a frame member.

As shown in FIG. 3, an embodiment of the latch members 40 comprises a pivoting main body 42 having an upwardly extended arm or hook member 41 and an exposed actuating tab member 43. A latch retention mechanism 44 is provided to retain the latch member 40 within exterior slot 18 of the frame member 11 such that the latch members 40 may be adjusted or repositioned along frame member 11 in order to match up with the latch receiving slots in the existing troffer housing. The latch retention mechanism 44 may comprise one or more fasteners 45 extending though apertures in the main body 42 and connecting to one or more internal backing members 46, such as a nut or plate, of sufficient size to prevent outward separation of the latch member 40 from the frame member 11. The latch member 40 is easily assembled to the frame 11 by sliding it into the exterior slot 18 prior to assembly of the frame members 11 into the peripheral frame assembly. Other configurations for both the latch members 40 and the hinge members 30 are possible.

To retrofit an installed troffer light fixture to create an LED light fixture in place of a fluorescent lamp fixture, the installed troffer door or louver is removed from the troffer housing, the electrical components and fluorescent lamps are removed, and the incoming electrical wiring is disconnected. The hinge members 30 and latch members 40 of the troffer door assembly are then repositioned along frame members 11 to correspond to the locations of the hinge receiving slots and the latch receiving slots in the installed troffer housing. The hinge members 30 are then inserted into the installed troffer housing hinge receiving slots and the electrical wiring 51 is connected to the existing troffer housing electrical wiring. The troffer door assembly is then pivoted to the closed positioned and secured to the troffer housing by the latch members 40. The original troffer light fixture has now been converted to an LED light fixture without the need for removal of any interior components other than the fluorescent lamps and without the need for an experienced electrician.

It is contemplated that equivalents and substitutions for certain elements set forth above may be obvious to those of ordinary skill in the art, and therefore the true scope and definition of the invention is to be as set forth in the following claims.

I claim:

1. A troffer door assembly comprising:

a peripheral frame assembly comprising frame members composed of a heat conductive material;

a lens member retained within said peripheral frame assembly;

a light emitting diode (LED) light bar assembly comprising an array of LEDs and a rigid brace member, said rigid brace member composed of a heat conductive material such that said rigid brace member functions as a heat sink for heat produced by said LEDs;

wherein said rigid brace member is connected to at least two of said frame members such that said rigid brace member increases the rigidity of said frame assembly and such that heat is passed from said rigid brace member to said frame assembly such that said frame assembly also functions as a heat sink for heat produced by said LEDs, and wherein at least one frame member includes an elongated channel provided in an exterior facing surface of the frame member, wherein the channel extends the entire length of the frame member, and wherein the channel is configured to adjustably receive at least one of a latch member and a hinge member.

2. The troffer door assembly of claim 1, further comprising at least two mounting brackets, wherein a first mounting bracket couples a first end of the brace member to one of the frame members and a second mounting bracket couples a second opposing end of the brace member to another frame member.

3. The troffer door assembly of claim 1, further comprising mounting brackets composed of a heat conductive material, wherein said mounting brackets are connected to said rigid brace member and to said at least two frame members.

4. The troffer door assembly of claim 1, further comprising:

an elongated interior slot positioned on at least two of said frame members;

whereby said lens member comprises peripheral edges and said peripheral edges are positioned within said interior slots.

5. The troffer door assembly of claim 1, said at least one hinge member comprising:

a mounting plate, an extension member extending outwardly from said mounting plate, and a retention mechanism extending into the exterior elongated channel.

6. The troffer door assembly of claim 5, said at least one latch member comprising:

a pivoting main body having an upwardly extended arm member and an exposed actuating member, and a retention mechanism extending into said exterior slot.

7. The troffer door assembly of claim 1, said at least one latch member comprising:

a pivoting main body having an upwardly extended arm member and an exposed actuating member, and a retention mechanism extending into the exterior elongated channel.

8. The troffer door assembly of claim 1, further comprising a latch member that is adjustably coupled to one exterior channel via a fastener, such that the latch member is movable along the full length of the frame member.

9. The troffer door assembly of claim 8, further comprising a backing member that is disposed in the channel of the frame member and is configured to receive the fastener to adjustably couple the latch member to the frame member, wherein the backing member is movable in the channel along the entire length of the frame member, and wherein the fastener engages the backing member through the channel.

10. The troffer door assembly of claim 1, further comprising a hinge assembly comprising a hinge member, a backing plate, and a fastener coupling the hinge member and the backing plate together, wherein the backing plate is disposed in one of the channels of the frame member and movable within the channel along the entire length of the channel, and wherein the fastener engages the backing member through the channel.

11. The troffer door assembly of claim 1, wherein at least one frame member includes an elongated interior channel provided in an interior surface, and wherein the interior channel receives a peripheral edge of the lens member.

12. The troffer door assembly of claim 1, wherein the frame assembly includes four frame members, each frame member having an elongated channel provided in an exterior facing surface of the frame member.

13. A troffer door assembly comprising:

a peripheral frame assembly comprising frame members composed of a heat conductive material;

a lens member retained within said peripheral frame assembly;

a light emitting diode (LED) light bar assembly comprising an array of LEDs and a rigid brace member, said rigid brace member composed of a heat conductive material such that said rigid brace member functions as a heat sink for heat produced by said LEDs;

wherein said rigid brace member is connected to at least two of said frame members such that said rigid brace member increases the rigidity of said frame assembly and such that heat is passed from said rigid brace member to said frame assembly such that said frame assembly also functions as a heat sink for heat produced by said LEDs, and wherein a first frame member includes an elongated channel provided in an exterior facing surface and a second frame member includes an elongated channel provided in an exterior facing surface, wherein the second frame member is provided on an opposing side of the frame assembly from the first frame member, and wherein each channel is configured to adjustably receive at least one of a latch member and a hinge member.

14. The troffer door assembly of claim 13, wherein the elongated channels in the first and second frame members extend along the entire length of the first and second frame members, such that the at least one latch member and hinge member are adjustable along the entire length of the respective frame member to allow the at least one latch member and hinge member to be aligned with a receiving slot in a troffer housing.

15. The troffer door assembly of claim 13, wherein each of the first and second frame members further include a second elongated channel provided in an interior facing surface, and wherein the second elongated channels of the first and second frame members receive opposing edges of the lens member.

16. The troffer door assembly of claim 13, further comprising a latch member that is adjustably coupled to one exterior channel via a fastener, such that the latch member is movable along the full length of the frame member.

17. The troffer door assembly of claim 16, further comprising a backing member that is disposed in the channel of the frame member and is configured to receive the fastener to adjustably couple the latch member to the frame member, wherein the backing member is movable in the channel along the entire length of the frame member, and wherein the fastener engages the backing member through the channel.

18. The troffer door assembly of claim 13, further comprising a hinge assembly comprising a hinge member, a backing plate, and a fastener coupling the hinge member and the backing plate together, wherein the backing plate is disposed in one of the channels of the frame member and movable within the channel along the entire length of the channel, and wherein the fastener engages the backing member through the channel.

19. The troffer door assembly of claim 13, further comprising a third frame member and a fourth frame member, the third frame member and the fourth frame member having an elongated channel provided in an exterior facing surface and configured to adjustably receive at least one of a latch member and a hinge member.

20. The troffer door assembly of claim 13, further comprising at least two mounting brackets, wherein a first mounting bracket couples a first end of the brace member to one of the frame members and a second mounting bracket couples a second opposing end of the brace member to another frame member.

21. The troffer door assembly of claim 13, further comprising mounting brackets composed of a heat conductive material, wherein said mounting brackets are connected to said rigid brace member and to said at least two frame members.

22. The troffer door assembly of claim 13, said at least one latch member comprising:

a pivoting main body having an upwardly extended arm member and an exposed actuating member, and a retention mechanism extending into the exterior elongated channel.

23. The troffer door assembly of claim 13, said at least one hinge member comprising:

a mounting plate, an extension member extending outwardly from said mounting plate, and a retention mechanism extending into the exterior elongated channel.

24. The troffer door assembly of claim 23, said at least one latch member comprising:

a pivoting main body having an upwardly extended arm member and an exposed actuating member, and a retention mechanism extending into the exterior elongated channel.

25. A troffer door assembly comprising:

a peripheral frame assembly comprising frame members composed of a heat conductive material;

a lens member retained within said peripheral frame assembly;

a light emitting diode (LED) light bar assembly comprising an array of LEDs and a rigid brace member, said rigid brace member composed of a heat conductive material such that said rigid brace member functions as a heat sink for heat produced by said LEDs;

wherein said rigid brace member is connected to at least two of said frame members such that said rigid brace member increases the rigidity of said frame assembly and such that heat is passed from said rigid brace member to said frame assembly such that said frame assembly also functions as a heat sink for heat produced by said LEDs, and wherein the frame assembly includes four frame members, wherein each of the four frame members includes an elongated interior channel provided in an interior surface and an elongated exterior channel provided in an exterior surface, and wherein each interior channel receives a peripheral edge of the lens member.

26. The troffer door assembly of claim 25, further comprising a latch member that is adjustably coupled to one exterior channel via a fastener, such that the latch member is movable along the full length of the frame member.

27. The troffer door assembly of claim 26, further comprising a backing member that is disposed in the channel of the frame member and is configured to receive the fastener to adjustably couple the latch member to the frame member, wherein the backing member is movable in the channel along the entire length of the frame member, and wherein the fastener engages the backing member through the channel.

28. The troffer door assembly of claim 27, further comprising a hinge assembly comprising a hinge member, a backing plate, and a fastener coupling the hinge member and the backing plate together, wherein the backing plate is disposed in one of the channels of the frame member and movable within the channel along the entire length of the channel, and wherein the fastener engages the backing member through the channel.

* * * * *